US010544976B2

(12) United States Patent
Triska et al.

(10) Patent No.: US 10,544,976 B2
(45) Date of Patent: Jan. 28, 2020

(54) SOFT-SIDED COOLER

(71) Applicant: Walmart Apollo, LLC, Bentonville, AR (US)

(72) Inventors: Nathan Andrew Triska, Bella Vista, AR (US); Patrick Overbey, Rogers, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/715,751

(22) Filed: Sep. 26, 2017

(65) Prior Publication Data

US 2018/0087819 A1 Mar. 29, 2018

Related U.S. Application Data

(60) Provisional application No. 62/399,806, filed on Sep. 26, 2016.

(51) Int. Cl.
*F25D 3/00* (2006.01)
*F25D 3/06* (2006.01)
(Continued)

(52) U.S. Cl.
CPC ..... *F25D 3/06* (2013.01); *A45C 11/20* (2013.01); *A45F 3/04* (2013.01); *B65D 81/3897* (2013.01);
(Continued)

(58) Field of Classification Search
CPC ..... F25D 3/06; F25D 23/12; F25D 2331/801; A45C 11/20; A45F 3/04; B65D 81/3897
(Continued)

(56) References Cited

U.S. PATENT DOCUMENTS 2,704,627 A * 3/1955 Brulin et al. ..... B67B 7/28 141/329
4,673,117 A * 6/1987 Calton ..... A45C 11/20 224/148.3
(Continued)

FOREIGN PATENT DOCUMENTS

WO 2017079315 A1 5/2017
WO 2017136747 A1 8/2017
(Continued)

OTHER PUBLICATIONS

Amazon.com: ORCA Pod Cooler Backpack, Blue ORCPODBL: Sports & Outdoors, https://www.amazon.com/ORCACoolerBackpackBlueORCPODBL/ dp/B014PKBY3W, last viewed Oct. 14, 2016.
(Continued)

*Primary Examiner* — Peter N Helvey
(74) *Attorney, Agent, or Firm* — McCarter & English, LLP; David R. Burns

(57) ABSTRACT

Described in detail herein is cooler apparatus. The cooler can include an outer shell and an inner shell. The outer shell can include a top face, a bottom face, a front surface, back surface a first side and a second side. The top face can be secured to the cooler using a zipper. The top face can provide access the inner shell. One or more bottle openers can be affixed to the front surface of the outer shell. The front surface can further include an enclosure accessible using a zipper. The bottom side can be compressible in response to receiving pressure. One or more straps can be affixed to either the first side, second side or back surface of the cooler. The inner shell can form a volume to store physical objects. The cooler can be a backpack, tote or a 24-pack cooler.

21 Claims, 14 Drawing Sheets

(51) Int. Cl.

| | |
|---|---|
| ***F25D 23/12*** | (2006.01) |
| ***A45F 3/04*** | (2006.01) |
| ***A45C 11/20*** | (2006.01) |
| ***B65D 81/38*** | (2006.01) |

(52) U.S. Cl.
CPC ..... *F25D 23/12* (2013.01); *F25D 2331/801* (2013.01)

(58) Field of Classification Search
USPC ..... 383/6
See application file for complete search history.

(56) References Cited

U.S. PATENT DOCUMENTS 4,767,039 A * 8/1988 Jacober ..... A45C 11/20 224/153
5,095,718 A * 3/1992 Ormond ..... A45F 3/04 206/427
5,400,610 A 3/1995 Macedo
D375,403 S * 11/1996 Melk ..... D3/217
5,611,457 A * 3/1997 Ash, Jr. ..... A45F 3/04 221/185
5,826,746 A * 10/1998 Ash, Jr. ..... A45F 3/04 221/185
5,921,435 A * 7/1999 Billet ..... A45F 3/04 221/185
D428,249 S * 7/2000 Ash, Jr. ..... D3/217
6,237,776 B1 * 5/2001 Mogil ..... A45C 3/00 150/106
6,276,579 B1 8/2001 DeLoach
6,311,336 B1 * 11/2001 Gootrad ..... A41D 27/208 2/251
6,536,637 B1 * 3/2003 McLaughlin ..... A45F 3/04 224/148.1
D478,782 S 8/2003 Li
D492,160 S 6/2004 Lanman et al.
7,810,350 B2 * 10/2010 Shelton ..... A45F 3/04 62/371
D642,870 S 8/2011 Whitlock et al.
8,281,950 B2 10/2012 Potts et al.
D692,661 S 11/2013 Gupton, Jr.
8,777,045 B2 7/2014 Mitchell et al.
8,875,964 B1 * 11/2014 Vanderberg ..... A45F 3/04 220/666
8,910,819 B2 12/2014 Seiders
D732,348 S 6/2015 Seiders et al.
D732,349 S 6/2015 Seiders et al.
D732,350 S 6/2015 Seiders et al.
D732,899 S 6/2015 Seiders et al.
9,139,352 B2 9/2015 Seiders et al.
D752,347 S 3/2016 Seiders et al.
D798,670 S 10/2017 Seiders et al.
D799,276 S 10/2017 Seiders et al.
D799,277 S 10/2017 Seiders et al.
D799,905 S 10/2017 Seiders et al.
D801,123 S 10/2017 Seiders et al.
D802,373 S 11/2017 Seiders et al.
D805,851 S 12/2017 Sullivan et al.
D809,869 S 2/2018 Seiders et al.
D814,879 S 4/2018 Larson et al.
D815,496 S 4/2018 Larson et al.
D817,106 S 5/2018 Larson et al.
D817,107 S 5/2018 Larson et al.
2005/0133399 A1 6/2005 Fidrych
2006/0060625 A1 * 3/2006 Kuder ..... A45F 3/12 224/637
2006/0112723 A1 * 6/2006 Shelton ..... A45F 3/04 62/457.5
2006/0169729 A1 * 8/2006 Reis ..... A45F 4/04 224/154
2006/0283205 A1 * 12/2006 Carriere ..... A45C 13/02 62/457.2
2008/0061093 A1 * 3/2008 Pottharst ..... A45C 11/20 224/155
2009/0184143 A1 * 7/2009 Witt ..... A45C 7/0059 224/153
2010/0199711 A1 * 8/2010 Smith ..... A45C 11/20 62/457.4
2011/0290843 A1 * 12/2011 Sagan ..... A45F 3/04 224/637
2013/0043285 A1 * 2/2013 Cordray ..... A45C 11/20 224/148.3
2014/0144963 A1 5/2014 Moore et al.
2014/0166704 A1 * 6/2014 Perera ..... A45F 3/04 224/153
2015/0225164 A1 8/2015 Seiders et al.
2016/0101924 A1 4/2016 Mitchell et al.
2016/0174693 A1 * 6/2016 Pompliano ..... A45F 4/02 224/153
2016/0244239 A1 8/2016 Nash
2016/0257479 A1 9/2016 Seiders et al.
2017/0036844 A1 2/2017 Seiders et al.
2017/0158412 A1 6/2017 Seiders et al.
2017/0210542 A1 7/2017 Seiders et al.
2017/0305638 A1 10/2017 Sonntag et al.
2017/0313492 A1 11/2017 Seiders et al.
2018/0037394 A1 2/2018 Seiders et al.

FOREIGN PATENT DOCUMENTS

WO 2017136754 A1 8/2017
WO 2017184687 A1 10/2017
WO 2017197230 A1 11/2017
WO 2018075157 A1 4/2018

OTHER PUBLICATIONS

Polar Bear Coolers: H2O Waterproof Backpack Cooler, pdfcrowd.com, copyright 2016.
Shop RTIC Softpak 20, https://www.rticcoolers.com/shop/coolers/softpak/RTICSoftPak20Grey, last viewed Oct. 14 2016.
Amazon.com: Leopard Outdoot Vinyl Cooler Bag, Perfect for Camping, Fishing, Hiking or Outdoor Picnic, 24 Can Blue: Kitchen & Dining, https://www.amazon.com/LeopardOutdoorPerfectCampingFishing/dp/B01EXUV6JG, last viewed Oct. 14, 2016.
Academy Sports + Outdoors, Magellan Outdoors 24-Can Sport Backpack Cooler, http://www.academy.com/shop/pdp/magellan-outdoors-24-can-sport-backpack-cooler. Retrieved Aug. 16, 2017. 3 pages.
Aliexpress, 4 colors thermal leak-proof ice pack insulation cooler bag breast milk storage bag insulated lunch bag for women men. Chasiy. https://www.aliexpress.com/item/4-colors-thermal-leak-proof-ice-pack-insulation-cooler-bag-breast-milk-storage-bag-insulated-lunch/32273624390.html. Retrieved Aug. 17, 2017. 1 page.
Amazon, Leopard Outdoor Water Repellent Vinyl Cooler Bag, Perfect for Camping, Fishing, Hiking, or Outdoor Picnic, 24Can Blue. https://www.amazon.com/Leopard-Outdoor-Perfect-Campgin-Fishing/dp/B01EXUV6JG. Retrieved Aug. 17, 2017. 7 pages.
Artic Zone, 24 Can Cooler Backpack, http://arcticzone.com/catalog/product/24-can-cooler-back-pack/. Retrieved Aug. 16, 2017. 3 pages.
Bunnings warehouse, Esky 30 Can Hybrid Cooler With Ice Brick, https://www.bunnings.com.au/esky-30-can-hybrid-cooler-with-ice-brick_p3240507. Retrieved Aug. 16, 2017. 2 pages.
Ebay, Igloo 35 Can Tundra Cooler Bad with Antimicrobial Bag Great Outdoor—New, http://www.ebay.com/itm/IGLOO-36-Can-Tundra-Cooler-Bag-With-Antimicrobial-Bag-Great-Outdoor-Cooler-New/322160695025?_trksid=p2047675.c100011.m1850&_trkparms=aid%3D222007%26algo%3DSIC.MBE%26ao%3D1%26asc%3D37437%26meid%3Dbcf59a843d2645f4a694e4a431788fa6%26pid%3D100011%26rk%3D2%26rkt%3D5%26sd%3D221450956819. Retrieved Aug. 16, 2017. 3 pages.
Ebay, Openbox Picnic Time Zuma Insulated Cooler Backpack Black, https://www.ebay.com/p/OPENBOX-Picnic-Time-Zuma-Insulated-Cooler-Backpack-Black/691169840?_trksid=p2047675.m4097.I9055. Retrieved Aug. 16, 2017. 8 pages.

(56) References Cited

OTHER PUBLICATIONS

Ebay, Picnic Time 'Zuma' Insulated Cooler Backpack Black. https://www.ebay.com/sch/sis/html?itemId=291849751107&_nkw=Picnic+Time+Zuma. Retrieved Aug. 16, 2004. 11 pages.
Groupon Goods, Polar Pack 24-Can Insulated Cooler, https://www.groupon.com/deals/gg-24-can-double-cooler, Retrieved Aug. 16, 2017. 2 pages.
Rakuten Global Market, Cooler bag Nike thermos cooler box insulated bag leisure bag Nike/Sports Cooler 5 IREE-005N 05P. https://global.rakuten.com/en/store/kanerin/item/nkree005n/?s-id=borderless_recommend_item_en. dated May 30, 2015. 15 pages.
Shmukler, New body-sized Yeti cooler, Rambler bottles and a bigger Hopper, http://www.hatchmag.com/articles/new-body-sized-yeti-cooler-rambler-bottles-and-bigger-hopper/7713454. Hatch Magazine—Fly Fishing, etc., Feb. 1, 2016. 12 pages.
Yeskey, Bag Supplier, Top Sale Camping Cooler bag, lunch bag, cooler bag, http://www.yeskey.com/space/Anderson2725/products_info/Top-Sale-Camping-Cooler-bag-lunch-bag-cooler-bag-166081.html. Retrieved Aug. 16, 2017. 2 pages.
Yeti, Hopper Backflip 24, https://www.yeti.com/hopper-backflip-24/YHOPBF24.html, Apr. 10, 2018.

* cited by examiner

SOFT-SIDED COOLER

CROSS-REFERENCE TO RELATED PATENT APPLICATIONS

This application claims priority to U.S. Provisional Application No. 62/399,806 filed on Sep. 26, 2016, the content of which is hereby incorporated by reference in its entirety.

BACKGROUND

Portable, easy to carry and durable coolers can be convenient for carrying physical objects that need to stay insulated.

BRIEF DESCRIPTION OF DRAWINGS

Some embodiments are illustrated by way of example in the accompanying drawings and should not be considered as a limitation of the invention.

DESCRIPTION OF EXEMPLARY EMBODIMENTS

Described in detail herein is cooler apparatus. The cooler can include an outer shell and an inner shell. The outer shell can include a top face, a bottom face, a front surface, back surface a first side and a second side. The top face can be secured to the cooler using hinge and a zipper. The top face can provide access the inner shell. One or more bottle openers can be affixed to the front surface of the outer shell. The front surface can further include an enclosure or pocket accessible via a zipper. The bottom side can be formed of a compressible material that compresses in response to receiving pressure. One or more straps can be affixed to either the first side, second side or back surface of the cooler. The inner shell can form a volume to store physical objects. The cooler can be a backpack, tote or a 24-pack cooler.

Figure 1:
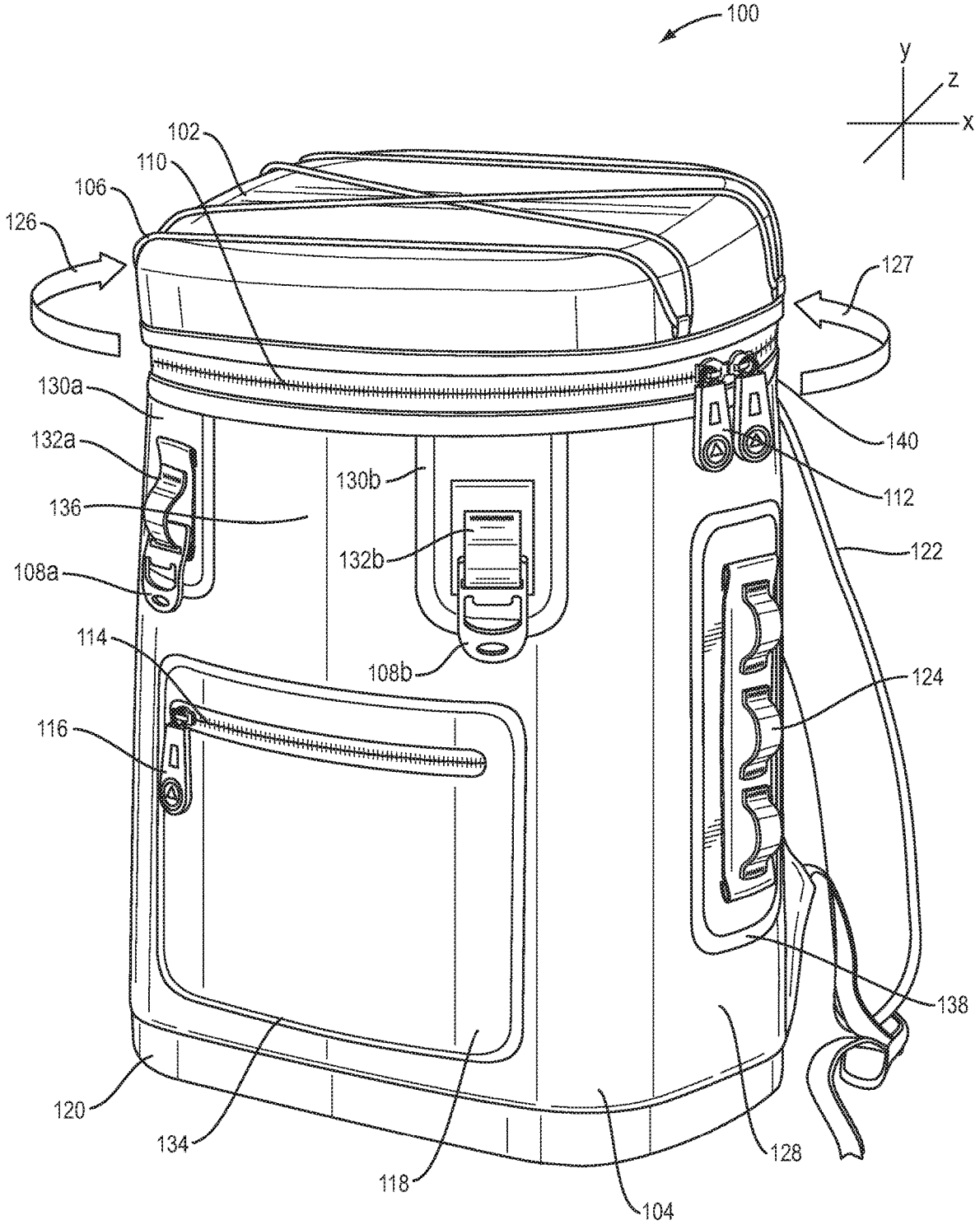
FIG. 1 illustrates a perspective front view of a soft side cooler embodied as a back-pack in accordance with the present disclosure.

FIG. 1 illustrates a perspective front view of a soft side cooler embodied as a back-pack 100 in accordance with the present disclosure. The backpack 100 can include an outer shell 136, a top face 102, a bottom face 120 and an inner shell (not shown). The outer shell 136 can be formed of a soft material that can be deformable in response to receiving pressure. As one example, the outer shell 136 can be formed of a 600D Poly Body with a Thermal Polyurethane (TPU) coating.

The top face 102 can be secured to the backpack using a hinge and a zipper 110. The hinge can be formed from a strip of material extending between the outer shell and the top face 102. The top face 102 can be formed a different material than the outer shell 136. As one example, the top face 102 can be made of an EVA compression foam base. The zipper 110 can be a tapped, one-way, water-proof zipper. For example when the zipper 110 is closed the top face 102 is secured to the outer shell 136 such that the interior of the backpack 100 is inaccessible. In this closed position, adjacent strips of waterproof tape extending the length of the zipper can engage each other to form a one way water tight seal between the top surface 102 and the outer surface 136 that prevents water from entering the interior of the backpack 100 from an exterior of the backpack 100. However, water in the interior of the backpack 100 can escape through the zipper 110 when the zipper is in the closed position. Thus, when the zipper is closed, the strips of tape prevent water from entering the backpack 100, but does not prevent water from exiting the interior of the backpack 100 through the zipper 110. When the zipper 110 is in the open position, the top face 102 can rotate along the z-axis in response to opening the zipper 110 using the one or more pull tabs 112. The one or more pull tabs 112 can slide along the zipper 110 in the directions indicated by the arrows 126-127. The backpack can be configured to be closed, partially open or completely open position in response to sliding the pull tab 112 along zipper 110. In a partial open position the top face can partially rotate around the z-axis and the interior cavity of the backpack 100 can be partially accessed. In a completely open position the top face 102 can be rotatable around the z-axis and the interior cavity can be completely accessed. The top face 102 can include bungee cords 106. The bungee cords 106 can be coupled into loops made of fabric that can be sewn, stitched, or welded to the top face 102. The bungee cords 106 can be can form a criss-cross formation on the top face 102.

The outer shell 136 can include, a front surface 104, a back surface 140 and a first and second side 128. The front surface 104 of the backpack 100 can include a one or more cavities. A first and second bottle opener 108*a-b* can be secured to fabric buckles 130*a-b* and the fabric buckles 130*a-b* can be sewn or stitched onto pieces of plastic 132*a-b* made of 600D Poly Body with Thermal Polyurethane (TPU) coating. The pieces of plastic 132*a-b* can be secured to the front surface by welding the plastic onto the one or more outer surface 136 of the front surface 104. The first and second bottle openers can be made of metal and can enable opening bottle tops from bottles. The first and second bottle openers can be disposed adjacent to each other and on the same plane.

The front surface 104 can further include a pouch or pocket 118 disposed underneath and the first and second bottle openers 108*a-b*. The pouch 118 can be made off plastic 134 such as 600D Poly Body with Thermal Polyurethane (TPU) coating. The pouch 118 can include an a cavity that accessible using the zipper 114 by pulling the pull-tab 116 along the x-axis. The pouch 118 can be welded onto the outer surface 136 of the front surface 104. The zipper 114 can be a tapped, one-way water-proof zipper similar to the zipper 110. The cavity of the pouch 118 can form an interior cavity to store physical objects. The interior cavity can be between the outer shell 136 and the inner shell. In this closed position, adjacent strips of waterproof tape extending the length of the zipper 114 can engage each other to form a one way water tight seal that prevents water from entering the cavity of the pouch 118 from an exterior of the pouch 118. However, water in the cavity of the pouch 118 can escape through the zipper 114 when the zipper is in the closed position. Thus, when the zipper 114 is closed, the strips of tape prevent water from entering the backpack 100, but does not prevent water from exiting the cavity of the pouch 118 through the zipper.

The bottom side 120 of the backpack can be a compressible in response to receiving pressure. As one example, the bottom side 120 can be made of an EVA compression foam base. The bottom side 120 can compress and reduced in size (e.g., thickness), as the pressure is received by the backpack 100. The bottom side 120 can expand in size as pressure is relieved from the backpack 100. The bottom side 120 can be configured to limit the amount of pressure received by the inner shell by absorbing the pressure.

Figure 3:
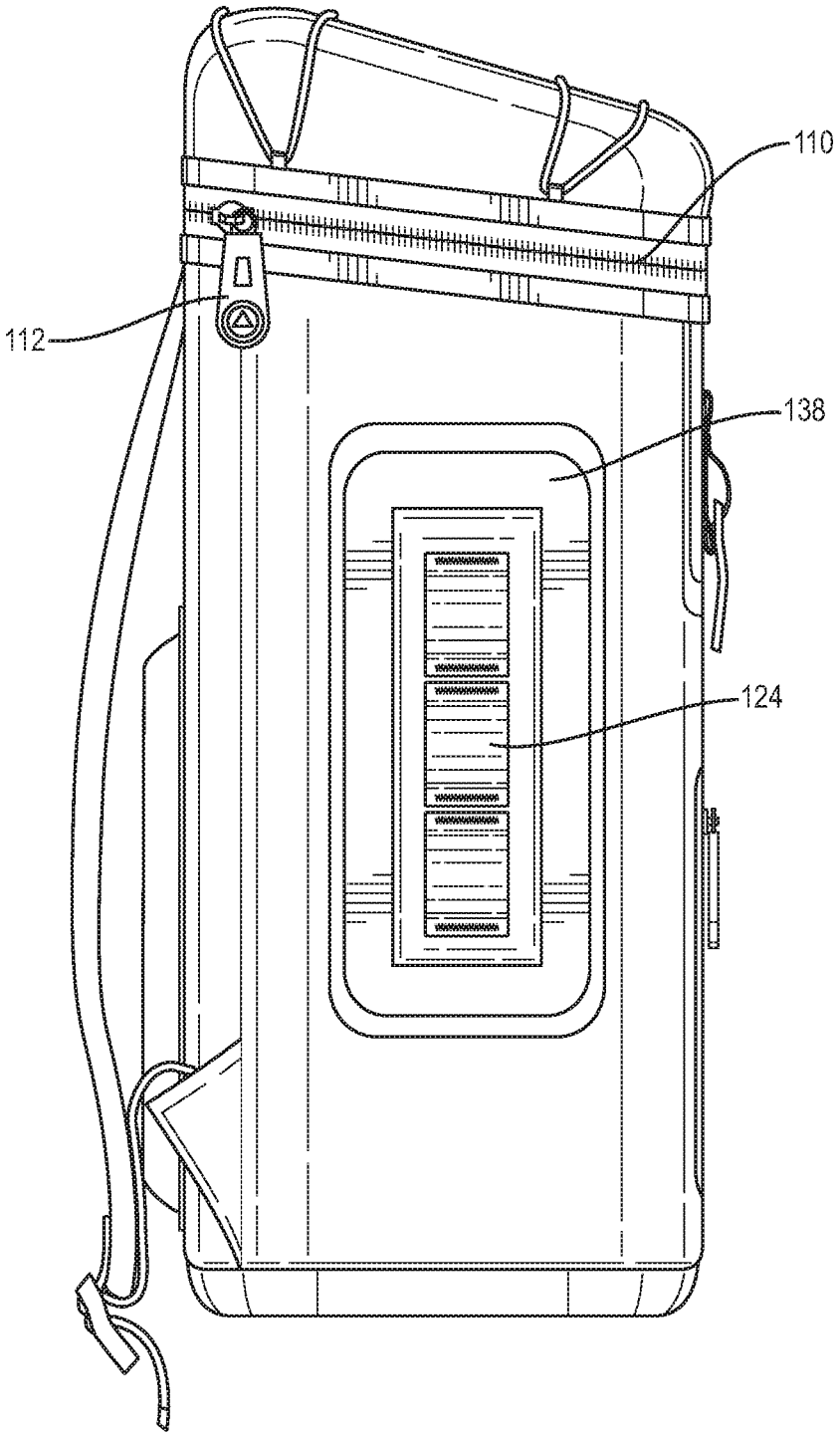
FIG. 3 illustrates a side view of a soft side cooler embodied as a back-pack in accordance with the present disclosure.

Referring to FIGS. 1 and 3, a piece of plastic 138 can be welded onto each of the first and second sides 128. The piece of plastic 138 can be made of 600D Poly Body with Thermal Polyurethane (TPU) coating. The piece of plastic 138 can include a set of buckles 124 extending along the side of the backpack. The buckles 124 can be made of fabric sewn or stitched onto a piece of plastic 138. The buckles 124 can form multiple loops for attachment to various physical objects. The back surface 140 can include two shoulder straps 124. The shoulder straps 124 can extend from below the zipper 110 down the length of the backpack 100. The first and second side 128 of the backpack can also include a portion of the zipper 110. The pull tab 112 can slide along the zipper 110 on the first and second side 128 of the backpack.

Figure 2:
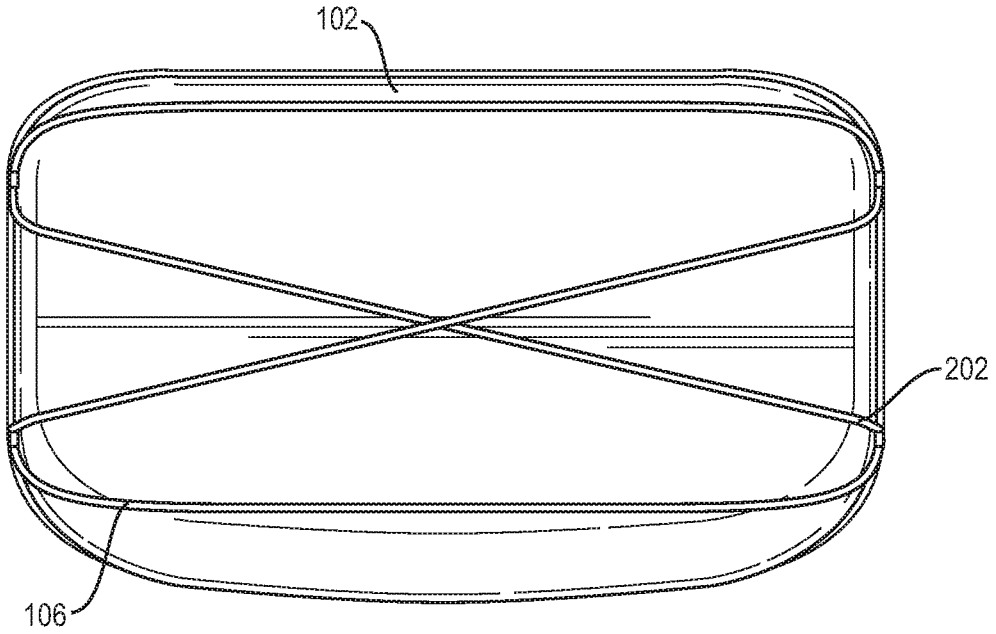
FIG. 2 illustrates a top view of a soft side cooler embodied as a back-pack in accordance with the present disclosures.

FIG. 2 illustrates a top view of a soft side cooler embodied as the backpack 100 in accordance with the present disclosures. The top face 102 of the back-pack can be made of EVA compression foam base. The top face 102 can include bungee cords 106 forming a criss-cross formation. The bungee cords 106 can be looped into pieces of fabric 202 which are sewn or stitched into the top face 102. The bungee cords 106 can be used to attach the backpack to various physical objects.

Figure 4:
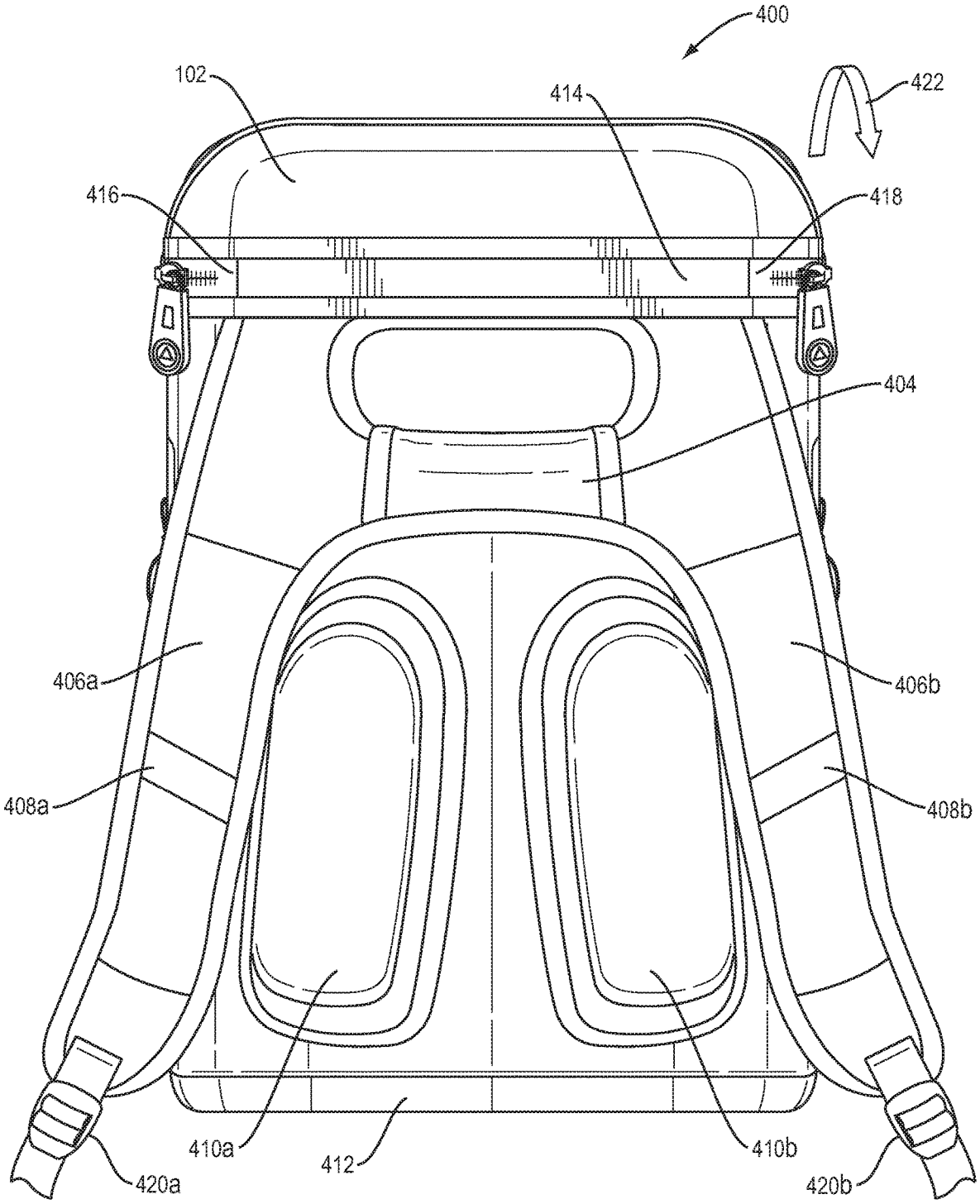
FIG. 4 illustrates a rear view of a soft side cooler embodied as a back-pack in accordance with the present disclosure.

FIG. 4 illustrates a rear view of a soft side cooler embodied as the backpack 100 in accordance with the present disclosure. As mentioned above the backpack can include a back surface 140. The back surface can include a the rear side of the top face 102, a handle 404, a first and second shoulder straps 406*a-b* and first and second pads 410*a-b*. The back surface 140 can include the terminal points 416 and 418 of the zipper 110. The back surface can form a hinge 414 at the terminal points 416 and 418 of the zipper 110. The top face 102 can rotate around the hinge 414 as indicated by the arrow 422. The first and second shoulder straps 406*a-b* can extend downward from the hinge 414. The first and second shoulder straps 406*a-b* can include fasteners 408*a-b* to fasten the backpack to various physical objects. The lower end of each shoulder strap 406*a-b* is attached to the backpack by an adjustable cinch-type buckle 420*a-b*. The adjustable clinch-type buckles 420*a-b* can tighten or loosen the shoulder straps 406*a-b* around a user's shoulder, when the backpack is being carried on the by the user around their shoulders. The top end of the shoulder straps 406*a-b* can be connected with each other by a handle 404. The handle 404 can form a bridge between the first and second shoulder straps 406*a-b* and form a U shape between the hinge 414 and the first and second shoulder straps 406*a-b*. The handle 404 can be used to pick up the backpack as well as attach the backpack to various physical objects. A soft fabric can be wrapped around the handle 404 to provide better grip to pick up the backpack. The rear surface 400 can also include a first and second pad 410*a-b*. The first and second pad 410*a-b* can be sewn or stitched into the fabric of the rear surface 400. The first and second pad 410*a-b* can be made of soft material providing padding for the back of the user when the user is carrying the backpack around their shoulders. The first and second pads 410*a-b* can extend downward along the back surface 140, toward the bottom side 412 of the backpack. The first and second pads 410*a-b* can be positioned adjacent to one another.

Figure 5:
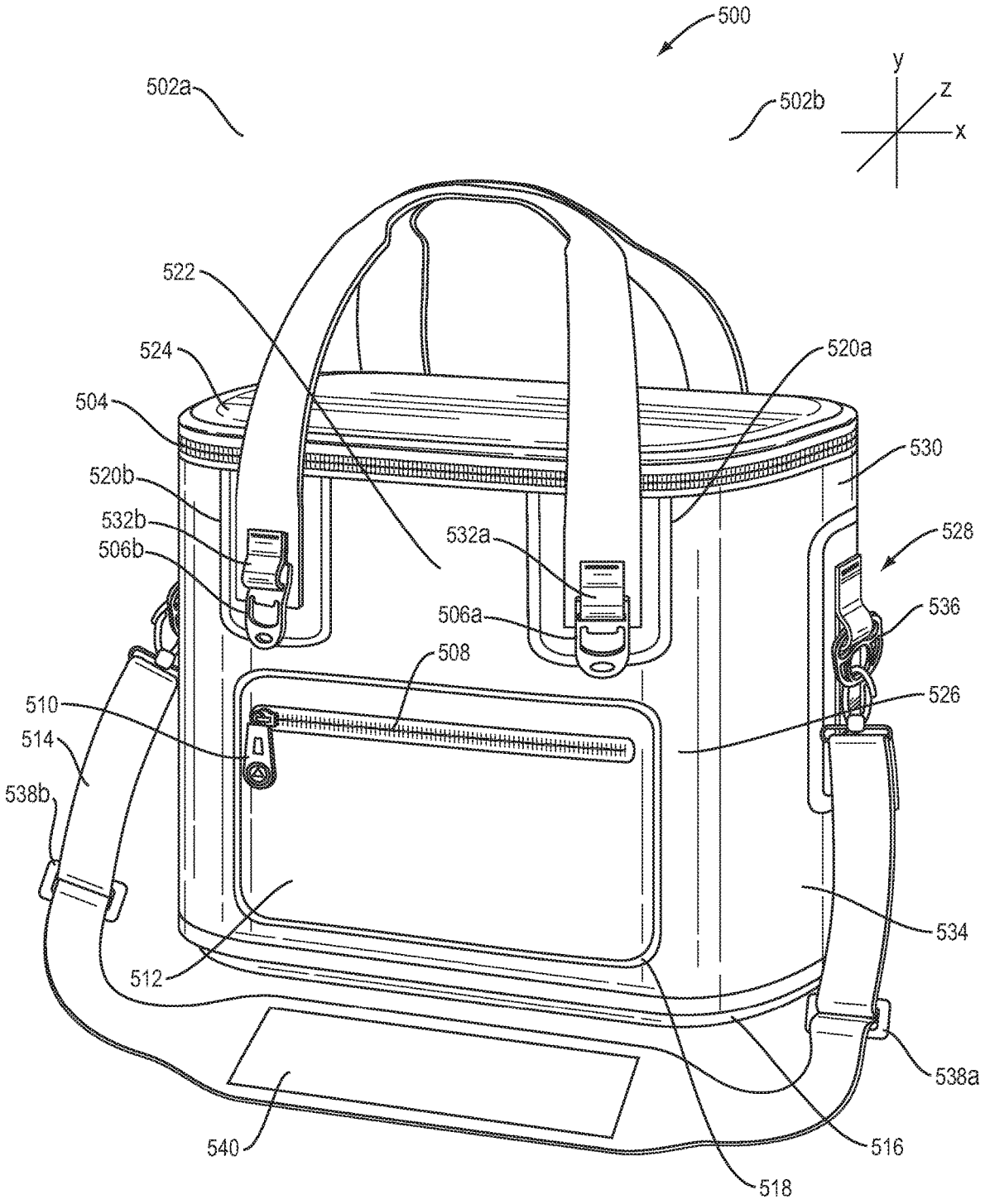
FIG. 5 illustrates a perspective front view of a soft side cooler embodied as a tote in accordance with the present disclosure.

FIG. 5 illustrates a front view of a soft side cooler embodied as a tote 500 in accordance with the present disclosure. The tote 500 can include an outer shell 522, an inner shell (not shown), a top face 524 and a bottom surface 516. The outer shell 522 can be a soft material that is deformable in response to receiving pressure. In example embodiments, the outer shell 522 can be made of a 600D Poly Body with a Thermal Polyurethane (TPU) coating.

The top face 524 can be secured to the tote 500 using a hinge and a zipper 504. The top face 524 can be made of 600D Poly Body with Thermal Polyurethane (TPU) coating and the zipper 504 can be a taped, one-way water-proof zipper such as those zippers described herein with reference to embodiments of the backpack 100 shown in FIGS. 1-4. The top face 524 can rotate along the z-axis when the zipper 504 is opened by using the one or more pull tabs (not shown). The tote 500 can be configured to be closed, partially open or completely open position in response to sliding the pull tab along zipper 504. In a closed position the top face 524 can be completely secured to the outer shell 522 and can access to the inner cavity of the tote 500 can be restricted. In a partial open position the top face 524 can partially rotate around the z-axis and the interior cavity of the tote 500 can be partially accessed. In a completely open position the top face 524 can be rotatable around the z-axis and the interior cavity can be completely accessed.

The outer shell 522 can further include a front surface 526, a back surface 528 and a first and second side 530. The front surface 526 can include a first and second bottle opener 506*a-b*, a pouch 512, and a zipper 508 with the pull tab 510. The front surface 526 can include one or more cavities. The pouch or pocket 512 can include accessed cavity that is accessible using the zipper 508 by pulling the pull-tab 510 along the x-axis. The pouch 512 can be welded onto on the outer surface 522 of the front surface 526. The zipper 508 can be a tapped, one-way water proof zipper such as those zippers described herein with reference to embodiments of the backpack 100 shown in FIGS. 1-4. The pouch 512 can have a cavity to store physical objects. In the closed position, adjacent strips of waterproof tape extending the length of the zipper 508 can engage each other to form a one way water tight seal that prevents water from entering the cavity of the pouch 512 from an exterior of the pouch 512. However, water in the cavity of the pouch 512 can escape through the zipper 508 when the zipper is in the closed position. Thus, when the zipper 508 is closed, the strips of tape prevent water from entering the backpack 100, but does not present prevent water from exiting the cavity of the pouch 512 through the zipper.

The first and second bottle opener 506*ab* can be secured to fabric loops 532*a-b* and the fabric loops 532*a-b* can be sewn or stitched onto pieces of a first strap 502*a*. The ends of the first strap 502*a* can be sewn or stitched onto a piece of plastic 520*a-b* made of a 600D Poly Body with a Thermal Polyurethane (TPU) coating. The pieces of plastic 520*a-b* can be secured to the front surface by welding the plastic onto the one or more cavities of the front surface 523. The first and second bottle openers 506*a-b* can be made of metal and can enable opening bottle tops from bottles. The first and second bottle openers 506*a-b* can be disposed adjacent to one another. The back surface 528 can include a second strap 502*b*. The second strap 502*b* can extend from below the zipper 504.

The bottom side 516 of the tote 500 can be a compressible in response to receiving pressure. The bottom side 516 can be made of a EVA compression foam base. The bottom side 516 can compress and reduce in size (e.g., thickness) as the pressure is received by the tote 500. The bottom side 516 can expand in size as pressure is relieved by the tote 500. The bottom side 516 can be configured to limit the amount of pressure received by the inner shell by absorbing the pressure.

Figure 6:
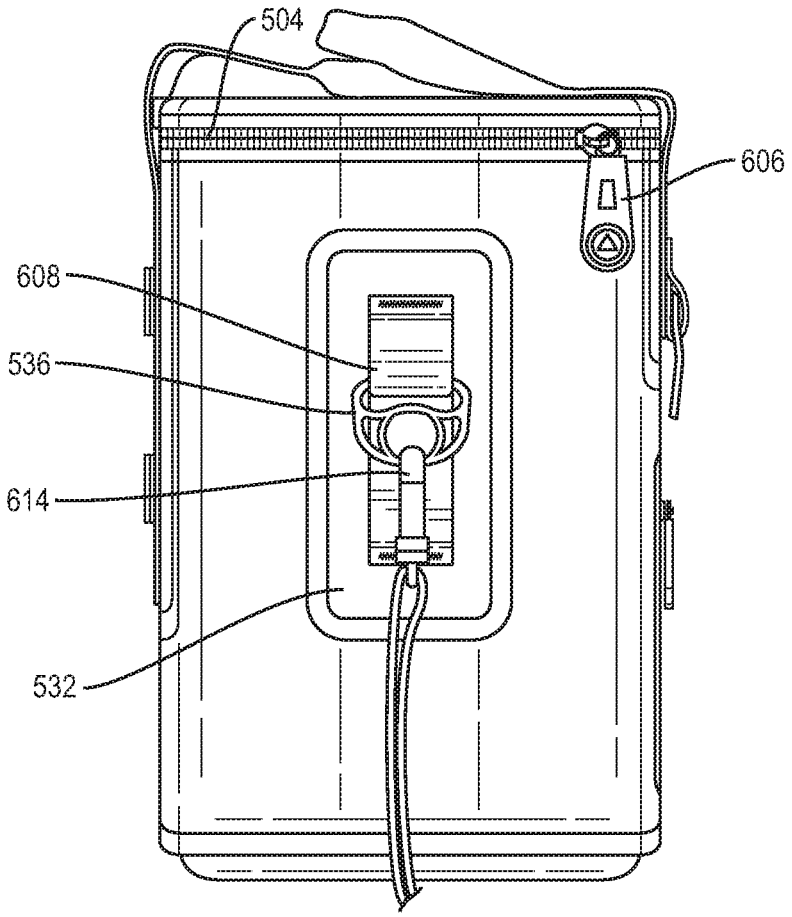
FIG. 6 illustrates a side view of a soft side cooler embodied as a tote in accordance with the present disclosure.

Referring to FIGS. 5 and 6, a piece of plastic 532 can be welded onto each of the first and second side 530. The piece of plastic 532 can include a buckle 536 sewed onto a piece of fabric 608 which is sewed or stitched onto the piece of plastic 532 made of a 600D Poly Body with a Thermal Polyurethane (TPU). The buckle 536 can be made of plastic and a strap 514 can attach onto the buckle 536 using a clip. The strap 536 can extend from the buckle 536 on the first side of the tote to the buckle 536 on the second side of the tote 500. The strap 536 can be a shoulder strap and include an adjustable soft padding. The strap 536 can also include clips 538*a-b* to adjust the size of the strap 536. With reference to FIG. 6, a strap (as shown in FIG. 5) can be attached to the buckle (e.g. buckle 536 as shown in FIG. 5) using a clip 614. The clip 614 can be hooked on to the loop of the buckle 536. The first and second side 530 of the tote can also include a portion of the zipper 504. The pull tab 606 can slide along the zipper 504 on the first and second side 530 of the tote.

Figure 7:
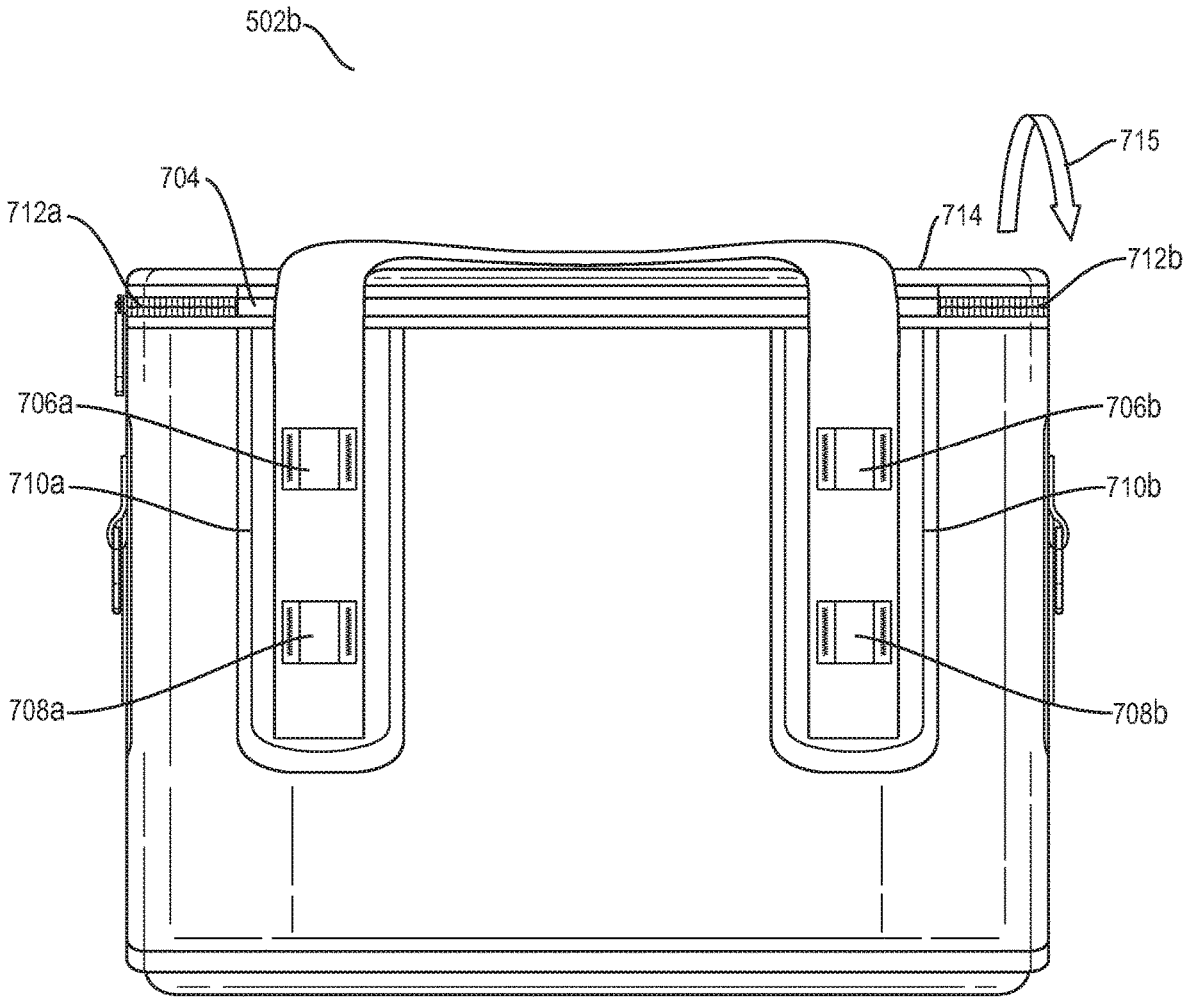
FIG. 7 illustrates a rear view of a soft side cooler embodied as a tote in accordance with the present disclosure.

FIG. 7 illustrates a rear view of a soft side cooler embodied as a tote in accordance with the present disclosure. As mentioned above, the outer shell can include a rear surface 528. The rear surface 528 can include one or more cavities. A first and second piece of plastic 710*a-b* made of 600D Poly Body with Thermal Polyurethane (TPU) can be welded on to the cavities of the rear surface 700. The rear surface 700 can include a strap 502*b* and ends of the strap 502*b* can be secured to the rear surface 700. The ends of the strap 502*b* can be sewed or stitched onto the pieces of plastic 710*a-b*. Each end of the strap 702 can include buckles 706*a-b* and 708*a-b* sewed or stitched onto the strap 502*b*. The buckles 706*a-b* and 708*a-b* can be used to attach the tote to various physical objects. The rear surface can further include the terminal ends 712*a-b* of the zipper. The rear surface 700 can form a hinge 704 at the terminal points 712*a-b* of the zipper. The top face 714 can rotate around the hinge 704 as indicated by the arrow 715.

Figure 8:
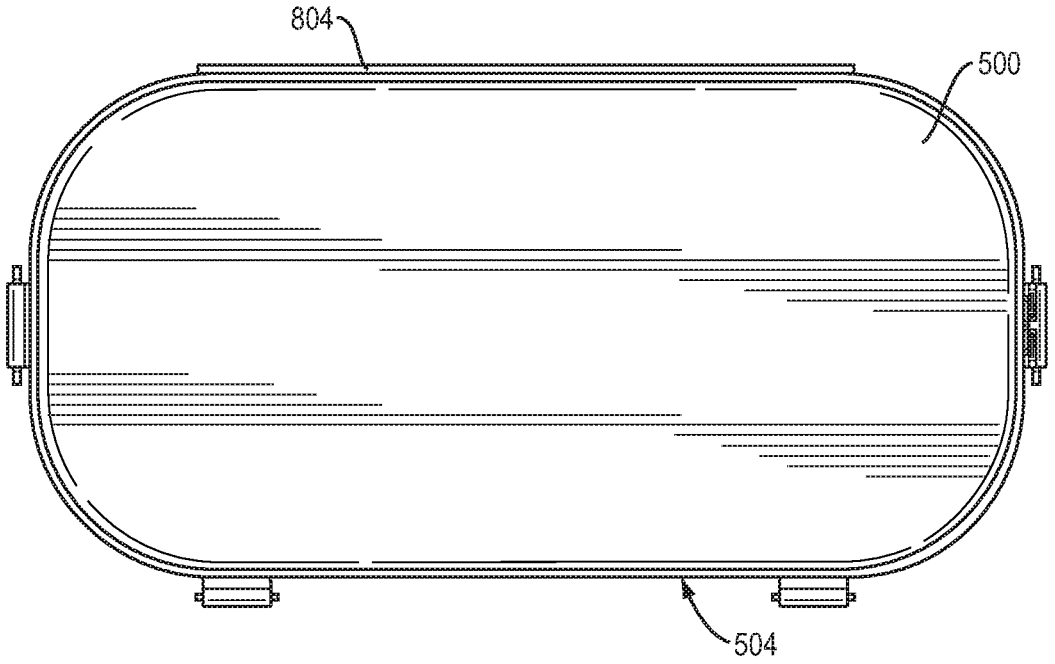
FIG. 8 illustrates a top view of a soft side cooler embodied as a tote in accordance with the present disclosure.

FIG. 8 illustrates a top view of a soft side cooler embodied as a tote 500 in accordance with the present disclosure. As mentioned above, the tote 500 can include a top face 524. The top face 524 can be made of the same material as the outer shell such as 600D Poly Body with Thermal Polyurethane (TPU). The top face 524 can restrict and provide access into the interior cavity of the tote. The top face 524 can be opened and closed using the zipper 504. In response to closing the zipper 504 of the tote 500, the top face 524 can be completely secured to the outer shell of the tote 500 in a closed position. In response to opening the zipper 504 of the tote 500, the top face 524 can rotate around a hinge 804 on the rear surface of the tote into an open position.

Figure 9:
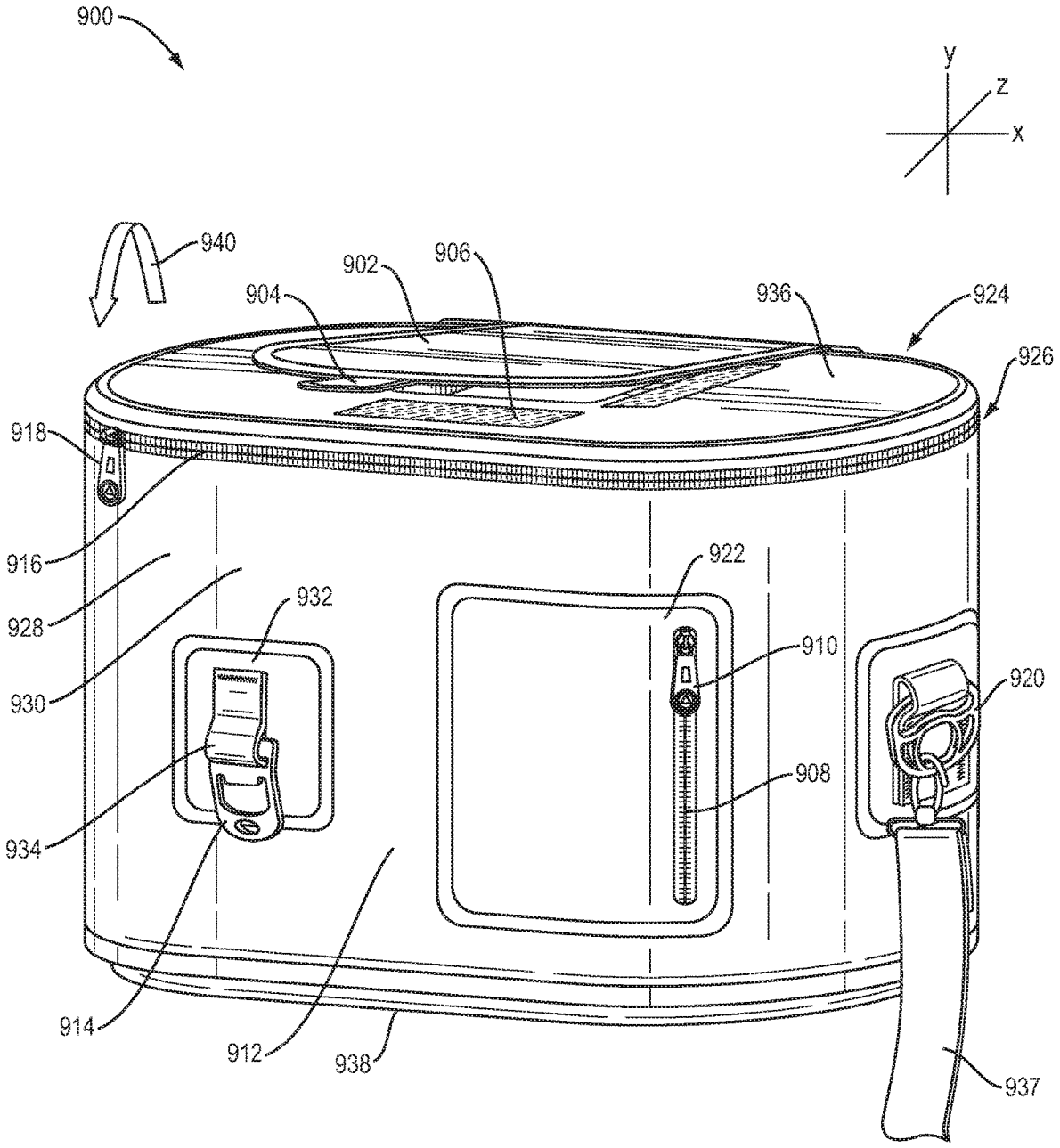
FIG. 9 illustrates a perspective front view of a soft side cooler embodied as a cooler in accordance with the present disclosure.

FIG. 9 illustrates a front view of a soft side cooler embodied as a 24-pack cooler 900 in accordance with the present disclosure. The 24-pack cooler 900 can include an outer shell 928, an inner shell (not shown), a top face 936 and a bottom surface 938. The outer shell 928 can be made of 600D Poly Body with Thermal Polyurethane (TPU) coating. The outer shell 928 can be a soft material, deformable in response to receiving pressure.

The top face 936 can be secured to the 24-pack cooler 900 using the zipper 916. The top face 936 can be made of 600D Poly Body with Thermal Polyurethane (TPU) coating and the zipper 916 can be a tapped, water-proof zipper. The top face 936 can rotate along the z-axis around a hinge (not shown) as indicated by the arrow 940, when the zipper 916 is completely opened using the one or more pull tabs 918. The 24-pack cooler 900 can be configured to be closed, partially open or completely open position in response to sliding the pull tab 918 along zipper 916. For example when the zipper 916 is closed the top face 936 is secured to the outer shell 928 such that the interior of the 24-pack cooler 900 is inaccessible. In this closed position, adjacent strips of waterproof tape extending the length of the zipper can engage each other to form a one way water tight seal between the top surface 936 and the outer shell 928 that prevents water from entering the interior of the 24-pack cooler 900 from an exterior of the 24-pack cooler 900. However, water in the interior of the 24-pack cooler 900 can escape through the zipper 916 when the zipper is in the closed position. Thus, when the zipper 916 is closed, the strips of tape prevent water from entering the backpack 100, but does not prevent water from exiting the interior of the 24-pack cooler 900 through the zipper 916. When the zipper 916 is in the open position, the top face 936 can be rotatable around the z-axis and the inner shell can be completely accessed. In a closed position the top face 936 can be completely secured to the outer shell 928 and access to the inner shell of the 24-pack cooler 900 can be restricted. In an partial open position the top face 936 can partially rotate around the z-axis and the inner shell of the 24-pack cooler 900 can be partially accessed. In a completely open position the top face 936 can be rotatable around the z-axis and the inner shell can be completely accessed.

The outer shell 928 can further include a front surface 930, a back surface 924 and a first and second side 926. The front surface 930 can include a bottle opener 914, a pouch 912, and a zipper 908 with the pull tab 910. The front surface 930 can include one or more cavities. The pouch 912 can include an enclosure accessed using the zipper 908 by pulling the pull-tab 910 along the y-axis. The pouch 912 can be welded onto a cavity on the front surface 922. The zipper 908 can be a tapped water proof zipper that permeates together to form a seal. The enclosure of the pouch 912 can form an interior cavity to store physical objects. The interior cavity can be between the outer shell 928 and the inner shell. In this closed position, adjacent strips of waterproof tape extending the length of the zipper 908 can engage each other to form a one way water tight seal that prevents water from entering the cavity of the pouch 912 from an exterior of the pouch 912. However, water in the cavity of the pouch 912 can escape through the zipper 908 when the zipper is in the closed position. Thus, when the zipper 908 is closed, the strips of tape prevent water from entering the 24-pack cooler 900, but does not prevent water from exiting the cavity of the pouch 912 through the zipper.

The bottle opener 914 can be secured to a fabric loops 934 and the fabric loop 934 can be sewn or stitched onto piece plastic 932 made of 600D Poly Body with Thermal Polyurethane (TPU) coating. The piece of plastic 932 can be secured to the front surface by welding the plastic onto the one or more cavities of the front surface 930. The bottle opener 914 can be made of metal and can enable opening bottle tops from bottles. The bottle openers 914 can be disposed adjacent to the pouch 912.

The bottom side 938 of the 24-pack cooler can be a compressible in response to receiving pressure. The bottom side 938 can be made of EVA compression foam base. The bottom side 938 can compress and shrink in size as the pressure is received by the 24-pack cooler 900. The bottom side 938 can expand in size as pressure is relieved by the 24-pack cooler 900. The bottom side 938 can be configured to limit the amount of pressure received by the inner shell by absorbing the pressure.

Each of the first and second side 926 can include one or more cavities. A piece of plastic can be welded into the cavity. The piece of plastic can include a buckle 920 sewed onto a piece of fabric which is sewed or stitched onto the piece of plastic made of 600D Poly Body with Thermal Polyurethane (TPU). The buckle 920 can be made of plastic and a strap 938 can attach onto the buckle 920 using a clip. The strap 937 can extend from the buckle 920 on the first side of the tote to the buckle 920 on the second side of the 24-pack cooler 900. The strap 937 can be a shoulder strap and include an adjustable soft padding. The strap 937 can also include a clip to adjust the size of the strap 937.

Figure 10:
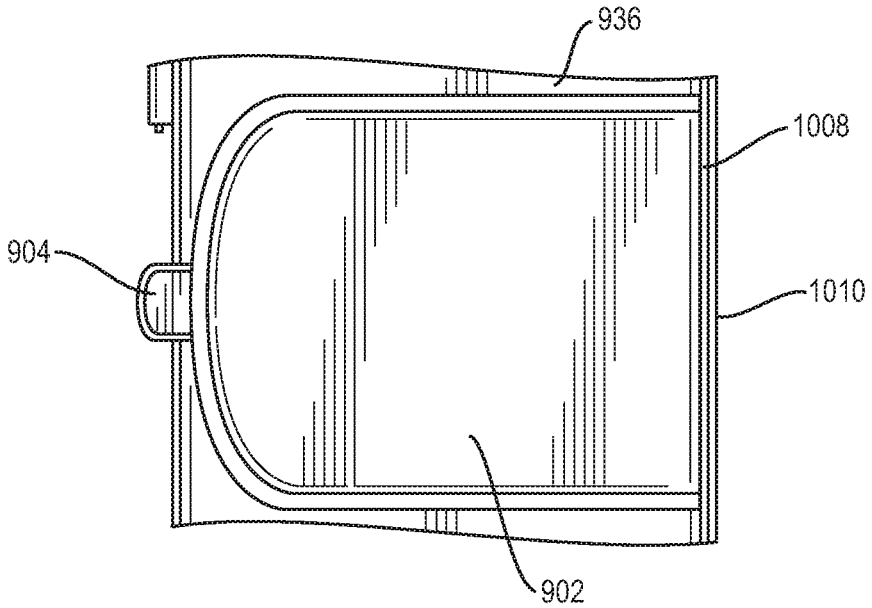
FIG. 10 illustrates a top view of a soft side cooler embodied as a cooler in accordance with the present disclosure.

With reference to FIGS. 9 and 10, the top face 936 can include a flap 902 providing partial access to the inner shell of the 24-pack cooler 900. The top face 936 can include a cavity, the flap 902 can cover the cavity. The flap 902 can open by lifting the tab 904. The flap 902 can rotate around the same hinge as the top face 936, around the z-axis. In a closed position the flap 902 can be secured to top face 936 by coupling with the Velcro™ material 906. The top face 936 can open by opening the zipper and rotating it around the hinge 1010. The top face 936 of the 24 pack cooler can include a flap 902. The flap 902 can cover a cavity on the top face 936. The flap 902 can open by lifting the tab 904 around the hinge 1008. By lifting the flap 904 the inner shell can be partially accessed through the cavity. In a closed position the flap can cover the cavity completely.

Figure 11:
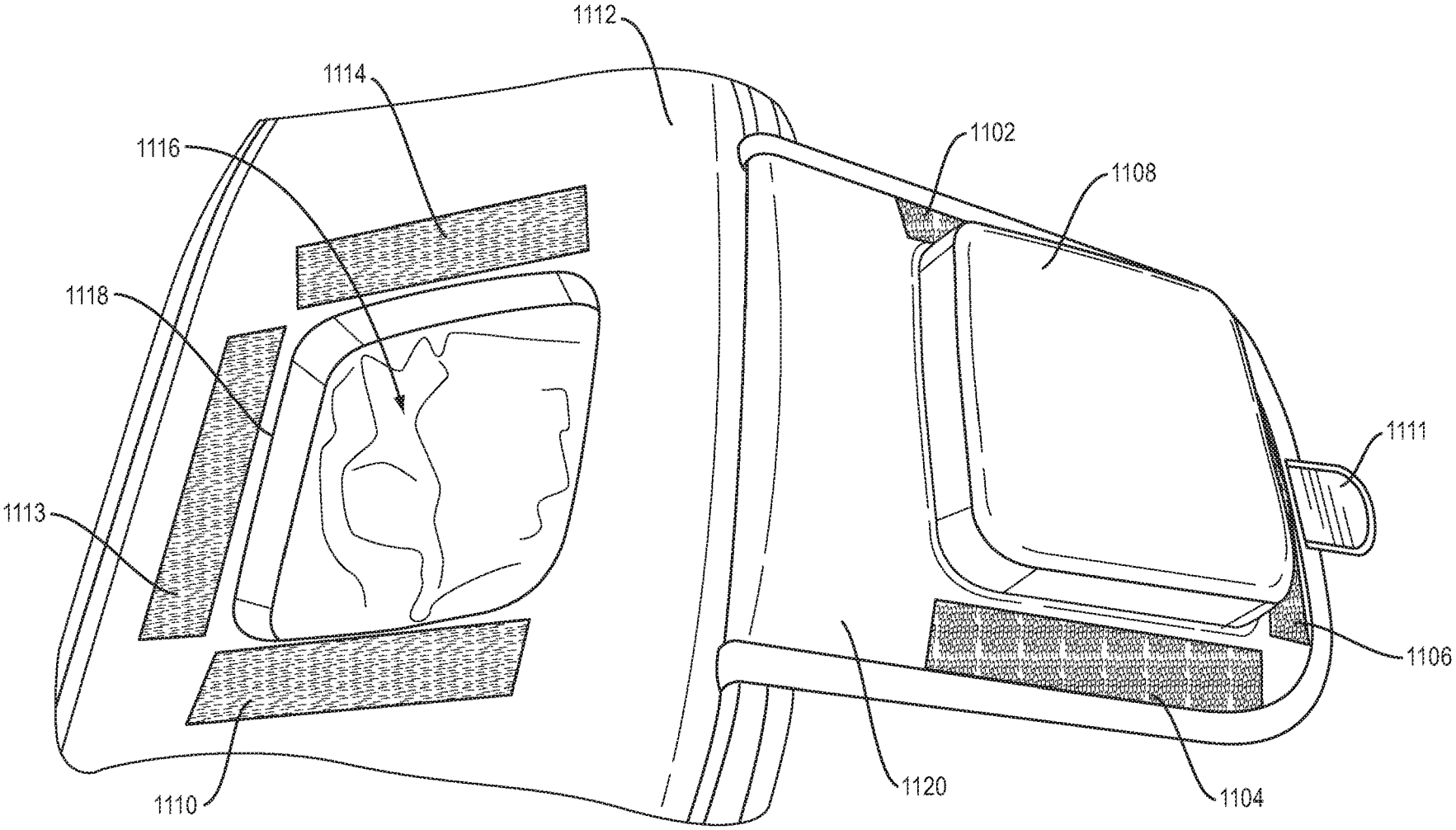
FIG. 11 illustrates a top view of a soft side cooler embodied as a cooler in accordance with the present disclosure.

FIG. 11 illustrates a top view of a soft side cooler embodied as a 24-pack cooler in accordance with the present disclosure. As mentioned above, the top face 1112 of the 24-pack cooler can include a flap 1120 which can provide access to the inner shell 1116 of the 24-pack cooler when in an open position through a cavity 1118. The rear side of the flap 1120 can be secured to the top face 1112 by coupling the pieces of Velcro™ 1102-1106 on the flap to the pieces of Velcro™ 1110, 1113, 1114 on the top face 1112. The flap 1120 can also include a protruding article 1108. The protruding article 1108 can have a perimeter that is smaller in size then a perimeter of the cavity 1118. When the flap 1120 is closed the protruding article 1108 can plug the cavity 1118. In exemplary embodiments the protruding article 1108 can have a thickness that is equal to or greater than a thickness of the top face 1112 such that when the flap 1120 is in the closed position, a distal surface of the protruding article 1108 aligns with an interior surface of the top face 1112 or extends into the cooler beyond the interior surface of the top face 1112. The flap 1120 can open and close using the tab 1111. Physical objects can be placed and removed from the inner shell 1116.

Figure 12:
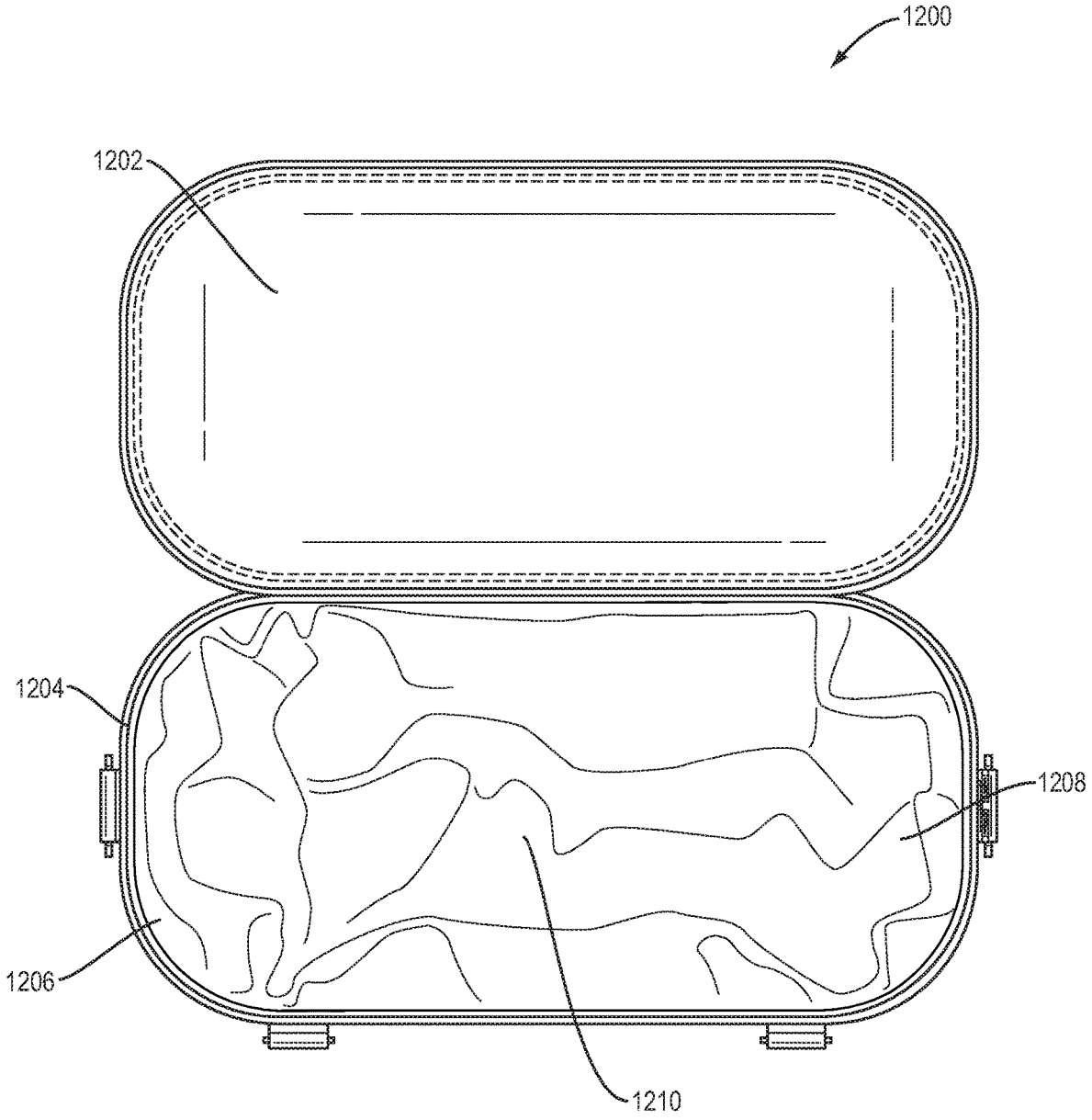
FIG. 12 illustrates the inside volume of a soft side cooler embodied in accordance with the present disclosure.

FIG. 12 illustrates an interior view of the inner shell of embodiments of the soft side coolers in accordance with the present disclosure. The soft side cooler 1200 can include an inner shell 1208. The inner shell 1208 can be included in the backpack, tote or 24-pack cooler as embodied above. The inner shell can be accessed by opening the zipper 1204 and uncoupling the top face 1202 from the outer shell of the soft side cooler 1200. The inner shell 1208 can be lined with insulation material 1206 such as 27 mm expandable polyethylene (EPE) foam insulation. Furthermore, the inner shell 1208 can include 600D Poly Liner with poly ethylene vinyl acetate coating. The inner shell 1208 can further include a 38 mm EPE foam base at the bottom of the inner shell. The inner shell 1208 can form a volume to store physical objects. The physical objects can stay insulated in the inner shell when the top flap 1202 is completely coupled with the outer shell.

Figure 13:
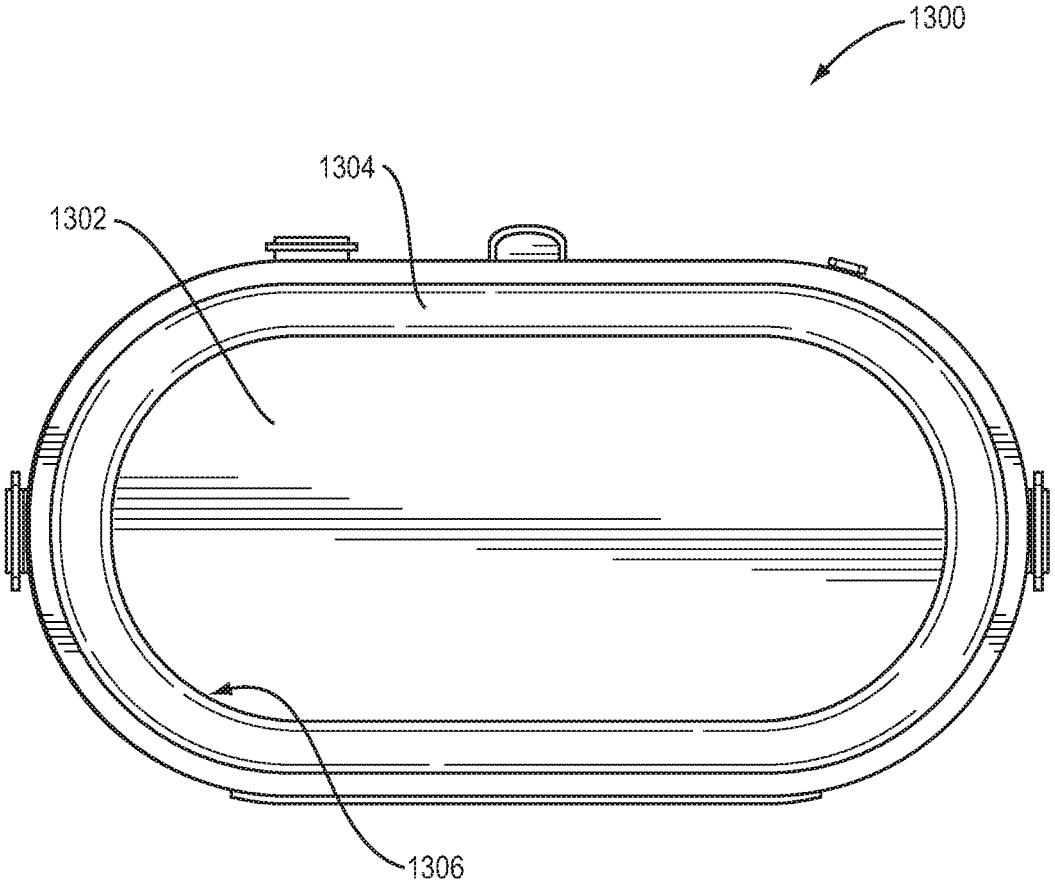
FIG. 13 illustrates the bottom of a soft side cooler embodied in accordance with the present disclosure.

FIG. 13 illustrates a bottom view of the soft side cooler in accordance with the present disclosure. As mentioned above, the soft side cooler 1300 when embodied as a backpack, tote or 24-pack cooler can include a bottom face 1302. The bottom face 1302 can be made of EVA compression foam. The bottom face 1302 can be compressible when receiving pressure. The bottom face 1302 can contract and expand in response to receiving pressure and when pressure is relieved from the bottom face 1302. In one embodiment, the bottom face 1302 can include a raised lip 1304 disposed around the perimeter of the bottom face 1302. The raised lip can be elevated as compared to the rest of the bottom surface 1302 as indicated by the arrow 1306.

Figure 14:
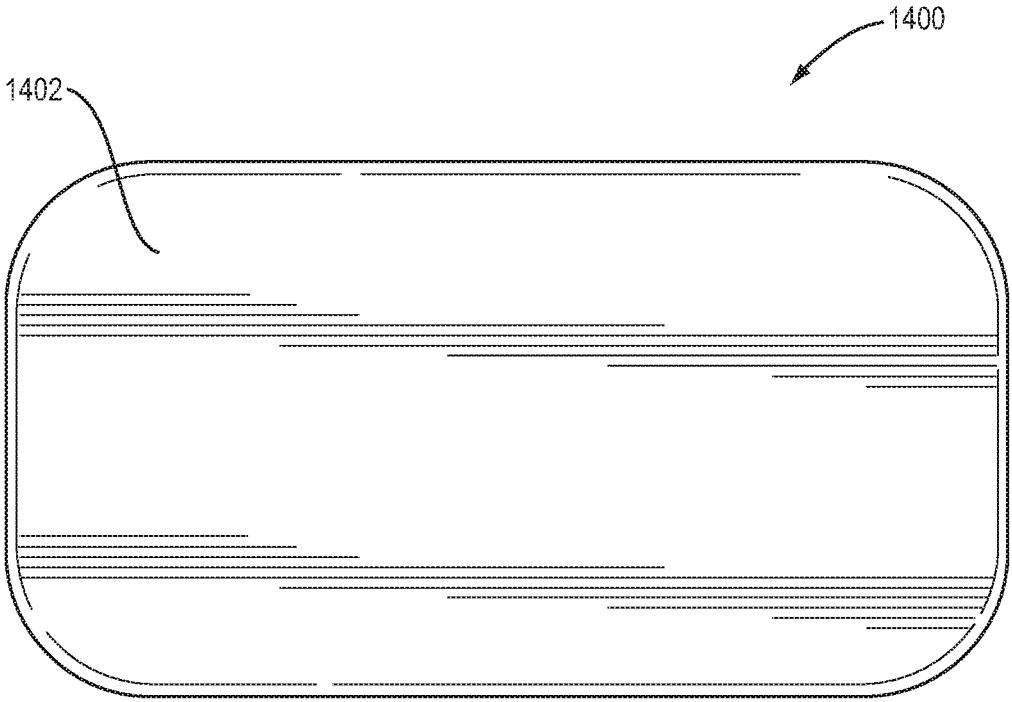
FIG. 14 illustrates the inside volume of a soft side cooler embodied in accordance with the present disclosure.

FIG. 14 illustrates a bottom view of the soft side cooler in accordance with the present disclosure. In another embodiment, the soft side cooler 1400 when embodied as a backpack, tote and 24-pack cooler can include a bottom surface 1402 without a raised lip. The bottom surface 1402 can be made of EVA compression foam. The bottom face 1402 can be compressible when receiving pressure. The bottom face 1402 can contract and expand in response to receiving pressure and when pressure is relieved from the bottom face 1402. The bottom surface 1402 can be an even shape throughout.

Exemplary flowcharts are provided herein for illustrative purposes and are non-limiting examples of methods. One of ordinary skill in the art will recognize that exemplary methods may include more or fewer steps than those illustrated in the exemplary flowcharts, and that the steps in the exemplary flowcharts may be performed in a different order than the order shown in the illustrative flowcharts.

What is claimed is:

1. A backpack apparatus comprising:

an outer shell including a front surface, a back surface, and a first and second side surfaces;

a top face coupled to the outer shell by a hinge and a first zipper, the first zipper being configured to rotate around the hinge formed at terminal ends of the first zipper;

a bottom face defining a base of the backpack apparatus;

the outer shell, top face and bottom face forming an inner shell constructed of insulated material including a volume for storing physical objects;

wherein the front face includes one or more bottle openers and a pouch accessible by a second zipper;

wherein each of the first and second side including one or more buckles; and wherein the top face and the bottom face are constructed from a material different from a material of the outer shell.

2. The backpack apparatus in claim 1, further comprising at least two shoulder straps coupled to the back surface.

3. The backpack apparatus in claim 1, wherein bungee cords are coupled to the top face of the backpack and the top face is constructed of EVA compression foam.

4. The backpack apparatus in claim 1, wherein the front surface comprises a first and second bottle cap openers.

5. The backpack apparatus in claim 1, wherein the pouch is disposed underneath the first and second bottle openers.

6. The backpack apparatus in claim 1, further comprising at least two back pads disposed on the back surface.

7. The backpack apparatus in claim 1, wherein the pouch is welded onto the front face.

8. The backpack apparatus in claim 1, wherein the first and second zippers are tapped, water-proof zippers.

9. The backpack apparatus in claim 1, wherein the material of the outer shell is 600D Poly Body with Thermal Polyurethane coating.

10. The backpack apparatus in claim 1, wherein the material of the bottom surface is EVA compression foam.

11. The backpack apparatus in claim 1, wherein the material of the inner shell is 27 mm expandable polyethylene (EPE) foam insulation and 600D Poly Liner with poly ethylene vinyl acetate coating.

12. A cooler backpack comprising:

an outer shell constructed of 600D Poly Body with Thermal Polyurethane coating and including a front surface; a back surface and a first and second side;

a top face constructed of EVA compression foam coupled to the outer shell by a first zipper, the top face configured to rotate around a hinge formed at terminal ends of the first zipper, wherein bungee cords are coupled to the top face;

a bottom face constructed of EVA compression foam;

the outer shell, top face and bottom face forming an inner shell constructed of 27 mm expandable polyethylene (EPE) foam insulation and 600D Poly Liner with poly ethylene vinyl acetate coating and including a volume for storing physical objects;

wherein the front surface including a first and second bottle cap opener coupled to first and second article of fabric and a pouch accessible by a second zipper, the first and second article of fabric coupled to a first and second piece of plastic and the first and second piece of plastic and the pouch are welded onto the front surface;

wherein two shoulder straps are coupled to the back surface;

wherein each of the first and second side including a first and second set of buckles constructed of fabric, coupled to a third and fourth article of plastic and the third and fourth articles of plastic are welded onto the first and second side; and wherein the first and second zipper are tapped water-proof zippers.

13. The backpack apparatus in claim 1, wherein a raised lip is disposed around the perimeter of the bottom face.

14. The backpack apparatus of claim 1, wherein the material of the top face and the bottom face defines an outer surface of the backpack apparatus at the top and bottom faces, and the material of the outer shell defines an outer surface of the backpack apparatus at the outer shell.

15. The backpack apparatus of claim 1, wherein the top and bottom faces are constructed from the same material.

16. The backpack apparatus of claim 1, wherein the first zipper forms a one way, watertight seal between the top source and the outer shell.

17. The backpack apparatus of claim 1, wherein in a closed position, the first zipper prevents liquid from entering an interior of the backpack apparatus from an exterior of the backpack apparatus through the first zipper, and allows liquid to escape from the interior of the backpack apparatus to the exterior of the backpack apparatus through the first zipper.

18. The backpack apparatus of claim 17, wherein in the closed position, the first zipper includes strips of tape that engage to prevent liquid from entering the backpack apparatus from the exterior of the backpack apparatus through the first zipper, the strips of tape allowing liquid to escape from the interior of the backpack apparatus to the exterior of the backpack apparatus through the first zipper.

19. The backpack apparatus of claim 18, wherein the strips of tape include adjacent strips of waterproof tape extending a length of the first zipper.

20. The backpack apparatus of claim 1, wherein the material of the bottom face is a compressible foam configured to compress and reduce in thickness upon application of pressure on the bottom face, compression of the bottom face absorbing pressure received by the inner shell.

21. The backpack apparatus of claim 1, wherein the bottom face defines a substantially planar surface including a raised lip disposed around the perimeter of the bottom face, the raised lip elevated as compared to the substantially planar surface of the bottom face.

* * * * *